United States Patent [19]

Goldman

[11] Patent Number: 4,765,254

[45] Date of Patent: Aug. 23, 1988

[54] REINFORCED SLAB STRUCTURE FOR THE ASSEMBLY OF SAFES, AND METHOD OF MAKING AND USE THEREOF

[75] Inventor: Ilan Goldman, Kfar Shmaryahu, Israel

[73] Assignee: Toot (Engineering) Ltd., Israel

[21] Appl. No.: 947,844

[22] Filed: Dec. 30, 1986

[30] Foreign Application Priority Data

Jan. 3, 1986 [IL] Israel ..... 77517

[51] Int. Cl.[4] ..... E04B 2/02

[52] U.S. Cl. ..... 109/85; 109/83

[58] Field of Search ..... 109/83, 82, 85, 84, 109/78–80, 45, 76, 65, 49.5; 52/405, 596, 602, 612; 264/34, 35

[56] References Cited

U.S. PATENT DOCUMENTS

| | | | |
|---|---|---|---|
| 370,471 | 9/1887 | Gross | 109/79 |
| 446,941 | 2/1891 | Williams | 109/83 |
| 787,065 | 4/1905 | White | 109/84 |
| 893,288 | 7/1908 | Walters | 109/84 |
| 918,952 | 4/1909 | Bowman et al. | 109/79 |
| 1,035,323 | 8/1912 | Cummings | 109/83 |
| 1,037,940 | 9/1912 | Lewis | 109/82 |
| 1,051,681 | 1/1913 | Cary | 109/76 X |
| 1,218,248 | 3/1917 | Ely | 109/79 |
| 1,564,205 | 12/1925 | Clark | 109/65 |
| 1,815,466 | 7/1931 | Fisher | 109/85 X |
| 2,750,902 | 6/1956 | McClellan | 109/82 X |
| 3,123,025 | 3/1964 | Fugelstad | 109/83 |
| 3,545,156 | 12/1970 | Ascari | 52/602 |
| 3,636,895 | 1/1972 | Kelsey | 109/78 |
| 4,183,188 | 6/1980 | Goldsby | 52/596 |
| 4,505,208 | 3/1985 | Goldman | 109/83 X |

FOREIGN PATENT DOCUMENTS

| | | | |
|---|---|---|---|
| 531764 | 8/1931 | Fed. Rep. of Germany | 109/82 |
| 655439 | 8/1934 | Fed. Rep. of Germany | 109/49.5 |
| 3123266 | 1/1983 | Fed. Rep. of Germany | 109/78 |
| 1317984 | 1/1963 | France | 109/83 |

*Primary Examiner*—Gary L. Smith
*Assistant Examiner*—Suzanne L. Dino
*Attorney, Agent, or Firm*—Ostrolenk, Faber, Gerb & Soffen

[57] ABSTRACT

A method of producing torch-and-drill proof slabs, and their use in the construction of modular safe walls. The slabs are formed by casting a metal plate having one, planar side and an opposite side formed with a series of parallel, generally V-shaped recesses. The recesses are divided by elongated projections so that every sloping side-surface of a recess intersects with an upright side-surface of a respective projection along a ridge line. A series of elongated, springy V-shaped steel bars are made, having opposite pointed side-edges extending parallel to each other, at a distance somewhat larger than the distance between the facing ridge lines. The bars are forcibly wedged from above into the recesses so that the pointed edges become snapped-in between opposite ridge lines.

14 Claims, 3 Drawing Sheets

REINFORCED SLAB STRUCTURE FOR THE ASSEMBLY OF SAFES, AND METHOD OF MAKING AND USE THEREOF

BACKGROUND OF THE INVENTION

The present invention relates to safes, vaults, strong boxes and the like, and more particularly to a method and structure of reinforced slabs, as well as to a modular construction of safes using the novel slabs. As a general rule, safes are constructed of large, heavy, hardened steel plates, welded together into the complete structure.

This traditional method of construction dictated strict standardization both in manufacturing techniques and dimensions. Customers had to adapt themselves to the commercially-available safe sizes, or make special orders for safes tailored to their particular space requirements and handling conditions.

One, obvious solution to this problem would be to devise safes based on the modular concept, whereby safes would be assembled, like LEGO(TM) pieces, into a variety of sizes, based on a stock of walls and door plates or slabs of various dimensions, and appropriate assembly fixtures. The reason that such a method has not been put into practice is that it would have seriously impaired the security level of the complete structure. An assembled structure is inherently liable to the disassemble thereof in the same way, unless welding, riveting or other non-reversible assembly techniques that can be performed only within the factory are applied, which, of course, brings us back to the practice of supplying completed, unitary safes. From another aspect, such modular safes which are to be supplied to the customer in a knocked-down or kit form, i.e. as a set of plates to be assembled at the customer's premises, would only be feasible and economically justified if the slabs were made by casting technique. However, although there are several known methods of casting slabs or plates that meet the high demands of torch-and-drill protection, yet they all still suffer various drawbacks, rendering them unsuitable for the purpose of mass production of modular safes.

Thus, for example, it has been proposed according to U.S. Pat. No. 4,505,208 to produce safe walls cast of high heat conductivity nonferrous metal such as aluminum or copper alloys, into which there is embedded a grille of special cast steel alloy. Although this method is satisfactory as far as security is concerned, it necessarily requires special casting dies and techniques to achieve the casting of a grille in suspension within a surrounding body of molten metal.

The traditional less sophisticated, so called "aluminum oxide nugget" method (an aggregate of aluminum clods dispersed within a body of cast aluminum or other nonferrous metal) is also unsuitable because the outer surfaces of the product are received so irregular and uneven that sheet metal covers had to be used, adding to production costs and to the dead weight of the safe.

The invention aims to remedy the above-listed disadvantages in both respects, of devising a simple and inexpensive method of production of safe wall plates, as well as proposing a method of quick and easy-to-perform construction of modular safes assembled of such plates.

It is a further object of the invention to provide a method of manufacture of high-security safe plates made of cast nonferrous metal, reinforced by drill-proof members, of higher resistance than cast steel grilles.

It is a still further object of the invention to perform the reinforcement of the cast slabs by hard elongated steel members, not during the casting stage—whereby the cooling-together of the composite structure may cause the annealing of the steel and the formation of cracks, due to differences in the thermal shrinkage coefficient to the two metals—but in a "cold" process, after the casting has become solidified.

SUMMARY OF THE INVENTION

According to one aspect of the invention there is provided a method of producing torch-and-drill proof slabs for use in the construction of safe walls, which includes the casting of a metal slab having one, planar side and an opposite side formed with a series of parallel, generally V-shaped recesses. Such recesses are divided by elongated projections so that every sloping side-surface of a recess intersects with an upright side-surface of a respective projection along a ridge line. Into each of the recesses, there is forcibly wedged an elongated, springy profiled metal bar having at least two opposite pointed side-edges extending parallel to each other at a distance somewhat larger than the distance between the facing ridge lines, so that the pointed edges become snapped-in between the opposite ridge lines.

According to another aspect of the invention there is provided a torch-and-drill proof slab for use in the construction of safe walls. The slab is cast of nonferrous metal alloy with elongated, generally V-shaped recesses. The recesses are divided by elongated projections so that every sloping side-surface of a recess intersects with an upright side-surface of a respective projection along a ridge line. The slab is further characterized by a springy profiled metal bar wedged between the projections by two pointed edges thereof being snapped-in between the opposite ridge lines.

BRIEF DESCRIPTION OF THE DRAWINGS

These and further characteristic features, advantages and particulars of construction will be more clearly understood in the light of the ensuing description of a preferred embodiment of the invention, given by way of example only, with reference to the accompanying drawings, wherein.

DETAILED DESCRIPTION OF THE PREFERRED EMBODIMENTS

Figure 1:
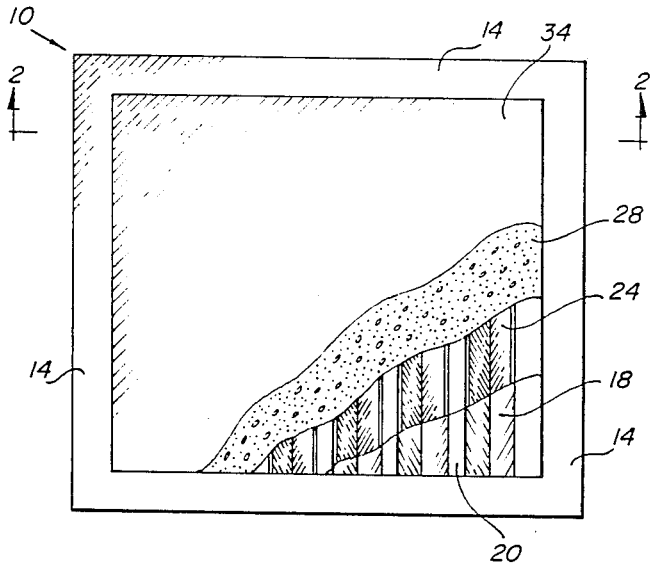
FIG. 1 is a top fragmental view of a modular safe wall slab comprising anti-drill reinforcement members according to the invention.
Figure 2:
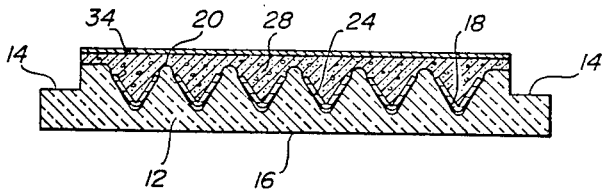
FIG. 2 is a section taken along lines 2—2 of FIG. 1.

As already mentioned, the common feature of all previously known, cast-based walls techniques involves the implantation or embedding of hard, anti-drill members or objects within the surrounding cast material. In contradistinction, according to the invention as exemplified in FIGS. 1–3, there is provided a hybrid slab structure which generally conforms to the dimensions, shape and other design features required for its use as a modular component of a safe. These requirements may differ from one case to another and hence, there is shown in FIG. 1 a simple, square slab 10 with base 12 and a surrounding recess 14. The base 12 is made of high heat-conductivity material, as conventionally known and used for this purpose, being a nonferrous metal such as aluminum or copper.

The base 12 is cast in a simple die-form (not shown) and comprises a flat bottom surface 16; at its top side, there extend a series of V-shaped, trough-like recesses 18 forming an acute angle a, divided by a complementary number of projections 20.

Figure 3:
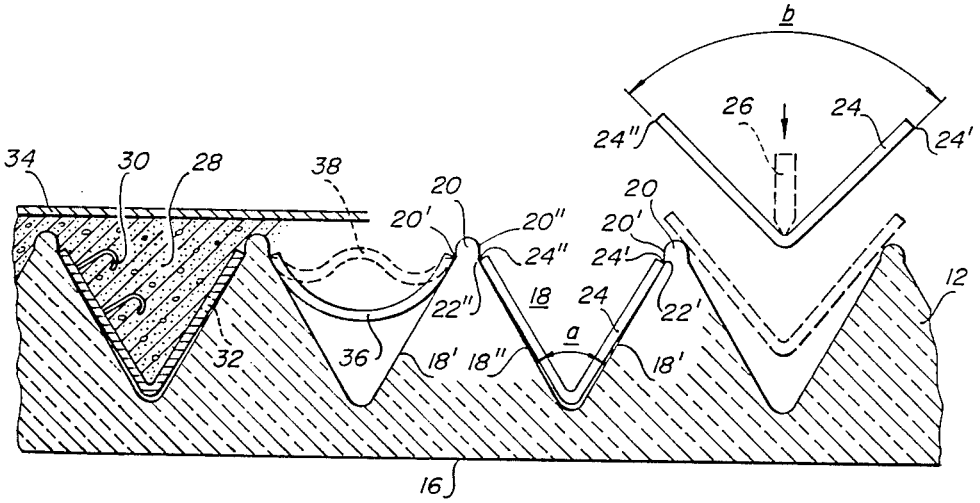
FIG. 3 shows a portion of the sectional view of FIG. 2, on an enlarged scale.

As more clearly seen in FIG. 3, the recesses 18 are defined by two sloping side-surface 18' and 18", each forming an obtuse-angled corner or ridge with a side wall of its respective projection 20. Thus, a first ridge 22' is formed by the surface 18' and side wall 20' of one projection 20, and a second ridge 22" is formed at the intersection of walls 18" and 20" of an adjacent projection 20; and so forth. Walls 20' and 20" are substantially vertical to the extent allowed by the die-casting process. After casting of the base 12, (including finishing processes such as trimming, sand-blasting and others), angled bars 24 are placed into the recesses 18 by a separate assembly operation. Bars 24 are made of steel, heat-treated to become hardened as well as springy, and are initially dimensioned to exactly fit the recesses 18, as shown. However, before thermal treatment, their angle b is made somewhat larger than the angles of the cast recesses 18. As schematically shown at the right-hand side of FIG. 3, the bars 24 are pressed into their respective recesses, e.g. by a press head 26 which causes the bars to flex and close or constrict their profile until snapped into the recesses 18, with their pointed, knife-like edges 24' and 24" fitting into the ridges 22' and 22", which thus serve as undercuts effectively preventing the escape of the bars 24 under a force applied in the opposite direction, e.g. during an attempted burglary.

To complete this structure of the slab 10 it is advisable to form a layer of any kind of an insulating material 28 such as concrete or ceramics on top of the bars 24 and projections 20. Bars 24 may further be provided with spikes 30 and/or bores 32 for better retaining the filling 28 within the recesses 18. A cover plate 34 completes the composite or hybrid structure of the slab 10.

It will be noted that the combination of torch-resistant, nonferrous metal cast base 12 (due to its high heat conductivity properties) with the wedged, springy steel bars 24 will satisfy the strictest security conditions and standards. Access to the bars 24, e.g., by sawing out portions of the cast metal 12 (by a compass saw or drill) will lead the burglar nowhere, thanks to the series of steel bars 24.

Incidentally, the angled shape of the bars 24 is advantageous also in the respect that it is highly resistant to drilling from the outside due to its sloping side surfaces; the drill will break rather than penetrate one or the other wings of the bar 24.

As shown at another portion of FIG. 3, the bars 24 may take different configurations, provided of course that the wedged or "snap-in" insertion thereof into the corners 22 is maintained. Thus, there may be used a semi-circular profile 36 with its convex side directed outward, or a wavy profile 38, as shown by broken lines.

Figure 4:
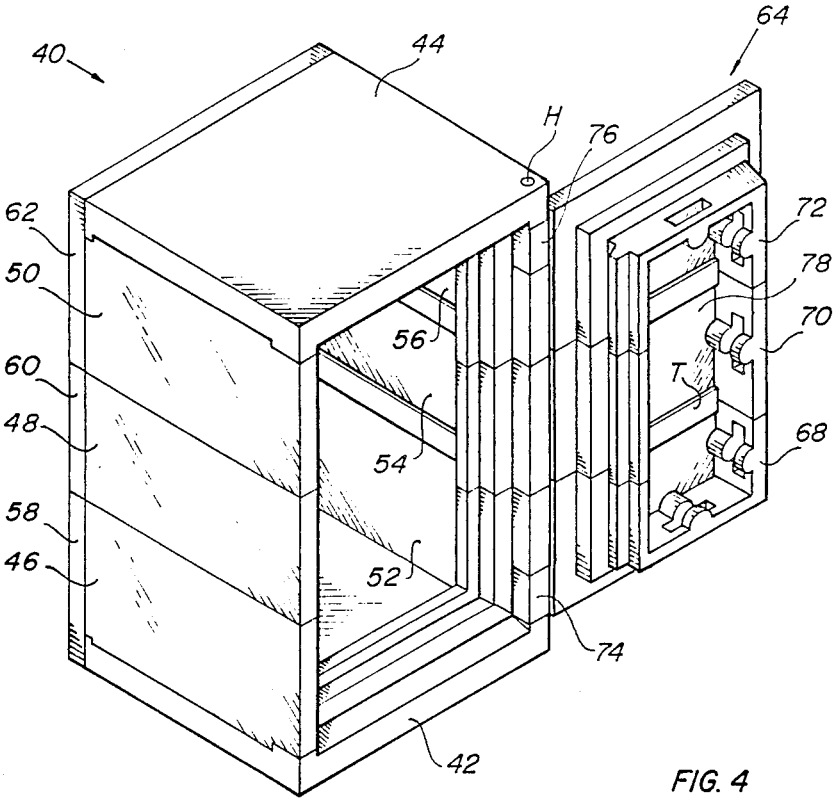
FIG. 4 is a general, three-dimensional view of one form of a safe assembled of slabs provided according to the invention.
Figure 6:
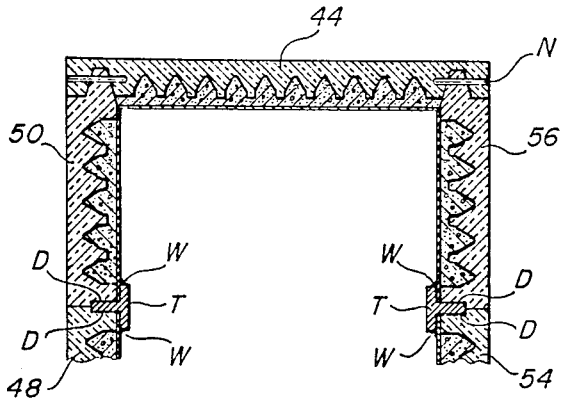
FIG. 6 is a sectional view of the safe of FIG. 4.
Figure 5:
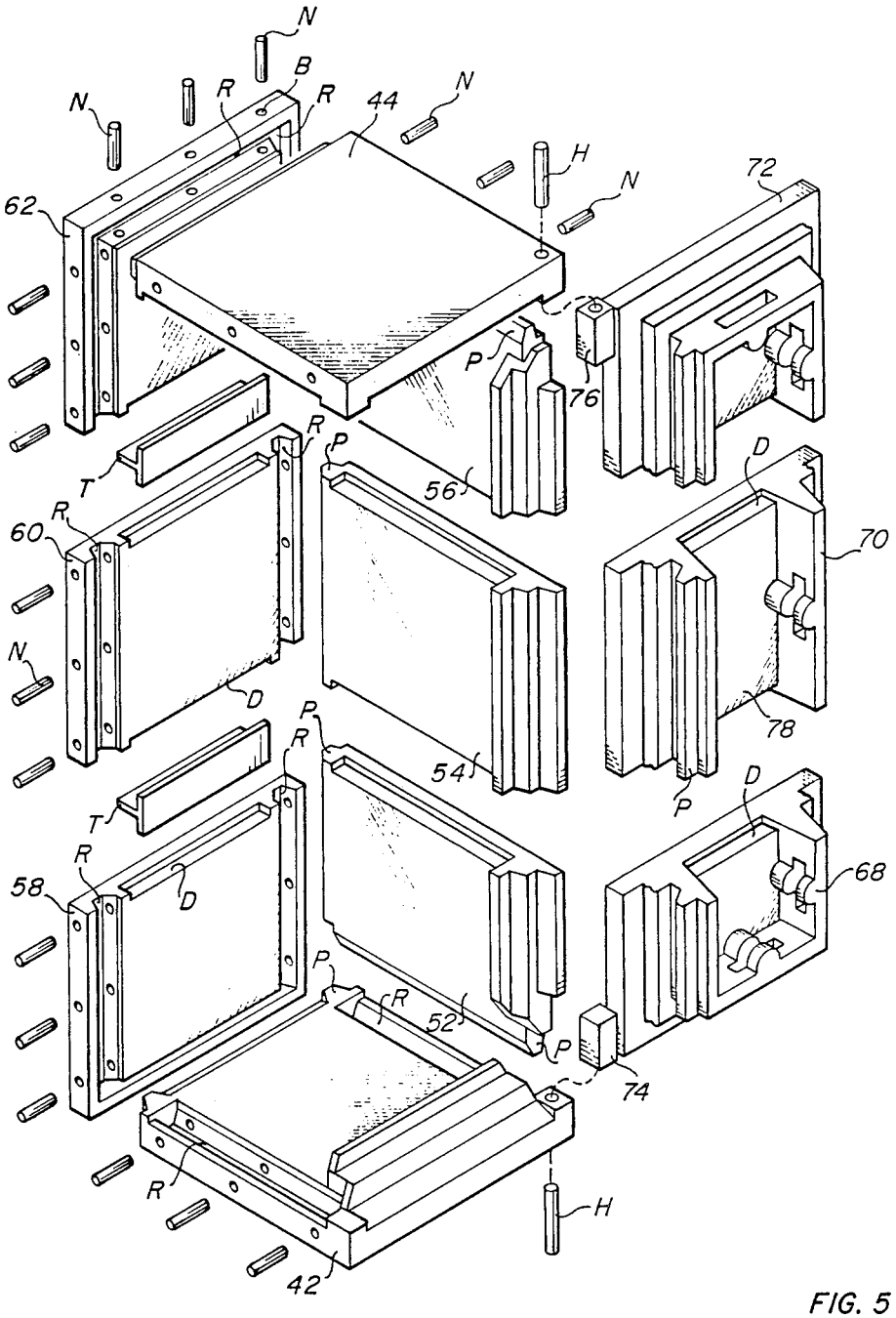
FIG. 5 is an exploded view of the safe of FIG. 4.

Referring now to FIGS. 4–6, there is exemplified a modular structure of a safe 40, conveniently assembled of slabs prepared and constructed in the manner heretofore described.

Safe 40 of FIG. 4 comprises a bottom slab 42, top slab 44, side-wall slabs 46, 48, . . . , 56, three back wall slabs 58, 60, 62 (FIG. 5) and a door 64 comprised again of three sections 68, 70 and 72. Of course, the number of the modular wall and door sections can vary according to customer requirements, as well as their relative dimensions.

For the in-site assembly of the safe 40, at customer's premises, the various slabs components are provided with assembly means as follows. One set of integral connectors is used to assemble the side wall to the back wall sections, which comprise, for every slab, elongated projections such as those designated P, configured to fit into complementary recesses generally denoted R in FIG. 5, wherever applicable.

It will be noted that this configuration of projections and recesses is chosen as being acceptable from the technological, die-casting point of view. There are further used T-shaped connectors denoted T, cooperating with shallow depressions D. The side walls and door, comprised of slabs 46–50, 52–56, 58–62 and 68–72—which define the ultimate height of the safe—are assembled in the factory using the T sections welded along lines W (FIG. 6) and are brought in unit form to the final assembly site; assembly is then carried out by placing the side and back walls on the bottom slab 42 (temporarily held together by a suitable fixture—not shown) and placing the top wall 44 thereon. Pins or nails N are then used to assemble all the components into a unified piece of structure. The pins N are preferably made of stainless steel, and provided with unidirectional knurling (not shown) that will prevent their extraction after being hammered into their receiving bores B. The door 64 is mounted and hinged into place using ears 74 and 76, and hinge-pins H inserted through the front right-hand corners of the bottom and top slabs 42 and 44, respectively.

A suitably shaped cavity 78 is formed in the door 64 for housing the locking mechanism of the door (not shown). While the above outlined assembly procedure and means have been found preferable, it goes without saying that many other configurations and possibilities are readily conceivable for the purposes in question. Similarly, it will be readily understood by those skilled in the art that various changes, modifications and variations may be applied to the other aspects of the invention as exemplified hereinabove, without departing from the scope of the invention as defined in and by the appended claims.

What is claimed is:

1. A method of producing slabs for use in the construction of safe walls comprising the steps of (a) casting a metal slab having one planar side and having an opposite side formed with a series of parallel, generally v-shaped recesses having sloping side surfaces, the recesses being separated by elongated projections having upright side-surfaces, so that every sloping side-surface of a recess generally intersects with an upright side-surface of a respective projection along a ridge line to there define an elongated ridge; and (b) forcibly wedging past the upright side surfaces and into each of the recesses an elongated, springy profiled metal bar having opposite side-edges which the bar normally urge apart and which edges are spaced apart at a distance somewhat larger than the distance between facing ridge lines so that the edges are held at the ridges between opposite ridge lines for preventing the bars from moving out of the recesses.

2. The method as claimed in claim 1 further comprising the step of casting a filling material layer above the bars and projections.

3. The method as claimed in claim 2 wherein the bars are made of thermally-hardened steel.

4. The method as claimed in claim 3 wherein the bars have a V-shaped profile.

5. The method as claimed in claim 3 wherein the bars are of a semi-circular profile.

6. The method as claimed in claim 3 wherein the bars are of a wavy profile.

7. The method as claimed in claim 1 wherein the casting is of a nonferrous metal such as aluminum alloy.

8. A slab for use in the construction of safe walls comprising a base portion of cast, nonferrous metal alloy having a side surface provided with elongated, parallel generally v-shaped recesses defined by sloping side surfaces, elongated projections between adjacent recesses, the projections having upright side surfaces, so that every sloping side-surface of a recess generally intersects with an upright side-surface of a respective projection along a ridge line to there define an elongated ridge, and a springy profiled metal bar having opposite edges which the spring bar normally urge apart the edges being spaced at a distance somewhat larger than the distance between facing ridge lines so that the edges of each bar are wedged between the projections by the two edges being held in the ridges between opposite ridge lines.

9. The slab as claimed in claim 8 further comprising a layer of filling material above the bars and projections.

10. A safe comprised of slabs according to claim 9, wherein the slabs are positioned at right angles to each other through the projections and the recesses fitting into each other and pins inserted through the interfitted projections and recesses for connecting the slabs.

11. The safe as claimed in claim 10 wherein slabs positioned at the same plane are welded to each other at adjacent sides thereof.

12. The safe as claimed in claim 11 wherein the slabs are welded intermediate the profiled bars partly inserted into recesses provided between adjacent slabs.

13. The method of claim 1, wherein the side edges of the metal bar are pointed and extended parallel to each other along the ridge lines.

14. The slab of claim 8, wherein the side edges of the metal bar are pointed and extend parallel to each other along the ridge lines.

* * * * *